US005450799A

United States Patent [19]

Goding

[11] Patent Number: 5,450,799

[45] Date of Patent: Sep. 19, 1995

[54] TRUCK PEDESTAL DESIGN

[75] Inventor: David J. Goding, Palos Park, Ill.

[73] Assignee: Amsted Industries Incorporated, Chicago, Ill.

[21] Appl. No.: 180,026

[22] Filed: Jan. 11, 1994

[51] Int. Cl.[6] ..... B61F 5/26

[52] U.S. Cl. ..... 105/222; 105/218.1

[58] Field of Search ..... 105/218.1, 220, 222, 105/225

[56] References Cited

U.S. PATENT DOCUMENTS

| | | | |
|---|---|---|---|
| 1,414,554 | 5/1922 | Doerr | 105/220 |
| 2,528,393 | 10/1950 | Shaffer | 105/220 |
| 3,276,395 | 10/1966 | Heintzel | 105/224.1 |
| 3,638,582 | 2/1972 | Beebe | 105/218.1 |
| 3,839,969 | 10/1974 | Thum | 105/224.1 |
| 4,109,586 | 8/1978 | Briggs et al. | 105/222 X |
| 4,111,131 | 9/1978 | Bullock | 105/224.1 |
| 4,236,457 | 12/1980 | Cope | 105/218.1 |
| 4,674,412 | 6/1987 | Mulcahy et al. | 105/224.1 |

*Primary Examiner*—Robert J. Oberleitner
*Assistant Examiner*—Kevin D. Rutherford
*Attorney, Agent, or Firm*—Edward J. Brosius; F. S. Gregorczyk; Thomas J. Schab

[57] ABSTRACT

A pair of opposed positioning lugs are attached to respective front and rear pedestal jaw walls of a railcar truck sideflame. The lugs are interposed between said respective jaw wall and the truck axle bearing assembly, laterally extending across the width of the sideframe pedestal jaw. The lugs function to independently maintain each axle in a right-angular relationship with respect to the truck sideframe when the sideframe travels upon linear track. Without the positioning lugs, each of the axles can potentially contact either of the pedestal jaw walls even when the truck travels upon linear track. This is due to the casting variances in the longitudinal length of each sideframe comprising the truck. When this type of truck negotiates a curve, an axle can be in contact with a pedestal jaw wall during linear truck travel to prevent the truck from steering as it was designed. The positioning lugs require widening of the longitudinal distance between the pedestal jaw walls before they can be installed; this ensures proper tolerances. Each of the positioning lugs is located on the axle longitudinal centerline and is preferably machined from the as-cast pedestal jaw material and when the truck proceeds onto a linear section of track, the positioning lugs will assist the axle back into a right-angular relationship between it and the sideframe. The positioning lugs can also be made from metallic shims welded to the pedestal walls.

12 Claims, 2 Drawing Sheets

TRUCK PEDESTAL DESIGN

FIELD OF THE INVENTION

The present invention relates to three-piece railroad car trucks and more particularly to a truck pedestal jaw arrangement which corrects for unintended bearing displacement that can prevent longitudinal axle motion necessary for axial steering and radial alignment in steerable trucks.

BACKGROUND OF THE INVENTION

In a conventional railway truck of the four-wheel type, the truck geometry is such that the axles are constrained by the bearings and sideframes to remain substantially parallel to each other under all conditions of operations. Generally, a ninety degree relationship is desired between the wheelsets and the sideframes during travel on straight track, while limited and restrained relative turning is permitted between the wheelsets and sideframes when the trucks travel along curved tracks.

If there are small differences in the longitudinal dimensions of the sideframe pair wheelbases or if there is longitudinal movement between the bearing adapter assembly and the pedestal jaws, wheel misalignment will be created, along with excess drag. These conditions will also open the opportunity for truck hunting to occur. Surprisingly, this means that drag can occur even on straight track. Under these conditions, a substantial amount of dragging and scraping of the wheels will occur, thereby wasting a great deal of locomotive horsepower and fuel in overcoming the friction forces associated with wheel misalignment.

To restrain the drag associated with wheel misalignment, prior art structures have interposed elastomeric devices between the bearing adapters and the sideframes for maintaining the wheelsets and sideframes in a generally right angular relationship to each other while traveling on straight track. These devices were said to significantly reduce truck misalignment and associated drag. Typical structures of these prior art devices are shown in U.S. Pat. Nos. 4,674,412, 3,638,582 and 3,276,395, that typically comprise an elastomeric pad sandwiched between a pair of plates. They are located between the bearing adapter and the roof of the pedestal jaw, and they require machining to install, but once installed, they accurately locate the bearing adapter between an opposed pair of machined thrust lugs on each pedestal jaw wall. However, it has been discovered that the as-cast pedestal jaw wall area near the axle centerline, even when cast to proper manufacturing tolerances, can limit wheel bearing displacement necessary for designed axle steering and radial alignment. Moreover, it has also been discovered that the same as-cast walls can be a major contributor to the cause of curving drag. Curving drag is considered herein to be the drag caused by the failure of the truck, for whatever reason, to permit the wheel sets to assume a radial orientation.

SUMMARY OF THE INVENTION

By the present invention, it is proposed to overcome the inadequacies encountered heretofore. To this end, it has been discovered that by adding positioning lugs to each of the pedestal jaw walls, specifically at the axle longitudinal centerline, the wheel bearings of the truck will be initially centered between the jaw pedestals without displacement of the bearing adapter elastomeric pad. This means that the bearing will be able to assume positions coincident with the radii of curves being negotiated without limiting axle longitudinal movement by contacting the pedestal jaw walls during curving. The positioning lugs will also cause the axles to return to a right angular relationship with respect to the sideframes when the truck returns to a linear section of track, thereby greatly reducing drag.

By the present invention, these difficulties are overcome by providing a laterally wider pedestal jaw area and then providing machined positioning lugs on each of the pedestal walls. Providing the wider jaw area is necessary to add the lugs and to avoid machining into the base surface of each pedestal wall. In the alternative, once the jaw area is widened, steel shims can be used instead of the lugs.

Further features of the present invention will be apparent from the following:

DESCRIPTION OF THE PREFERRED EMBODIMENT

Figure 1:
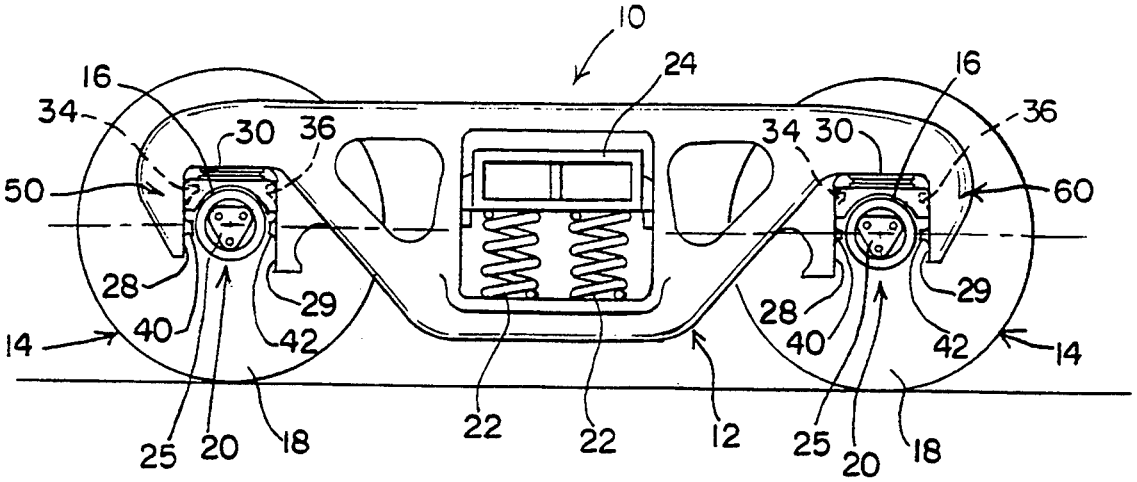
FIG. 1 is a perspective view of a railway vehicle incorporating the structure of the present invention.

Referring now to FIG. 1, there is shown a railway vehicle truck 10 typical to which the present invention is applied. The truck 10 generally comprises a pair of sideframes 12 mounted on spaced wheelsets 14. Each wheelset 14 is comprised of an axle 16, to which are mounted wheels 18, and roller bearings 25. Each of the sideframes 12 also include a bolster opening in which a bolster 24 is resiliently supported by springs 22. Bolster 24 is suitably attached to the underside of the railway vehicle car body (not shown) by means of center plate (not shown).

Figure 2:
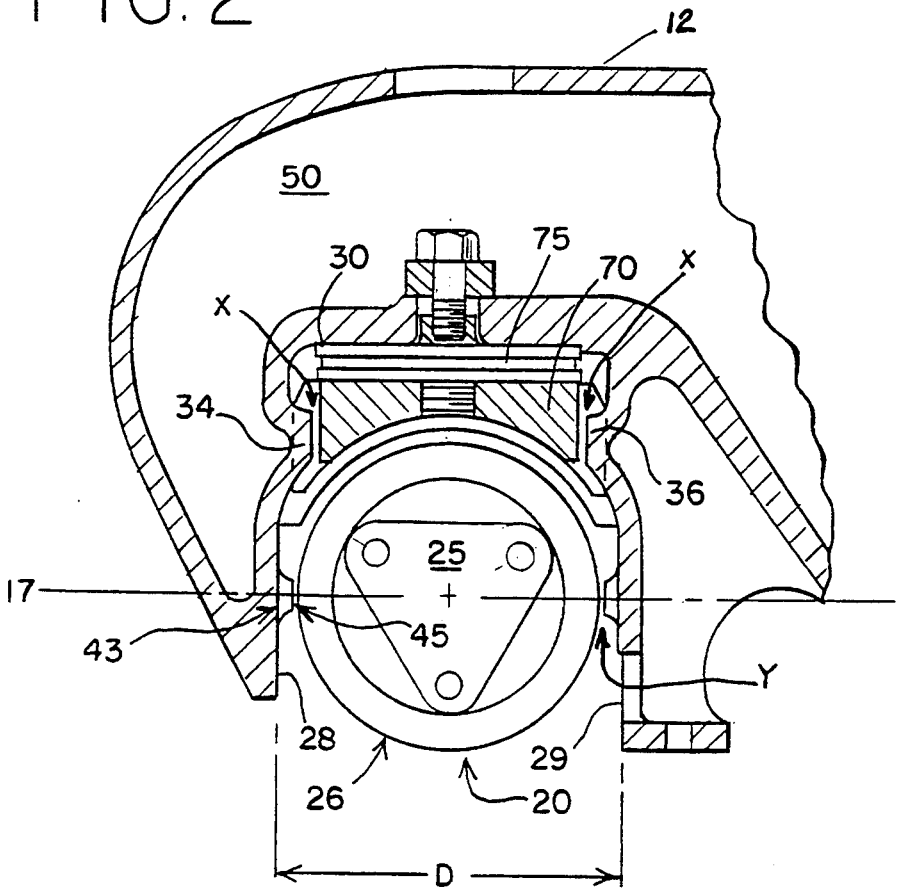
FIG. 2 is a cut away view of a sideframe pedestal jaw incorporating the present invention.

FIG. 2 illustrates that each sideframe end is composed of a pedestal jaw 50,60, which is formed by forward and rearward vertical walls 28,29 interconnecting with roof 30 to define the pedestal jaw opening 20 necessary for receiving the axle 16. Each pedestal jaw opening accepts a bearing adapter 70 that is mounted to roof 30. As best seen from viewing FIG. 2A, the adapter transverses the sideframe 12. A pair of opposed and transversely positioned pedestal thrust lugs 34,36, shown in FIG. 2, precisely position bearing adapter 70 longitudinally between each lug to specific tolerances so that the bearing adapter is longitudinally centered within each respective jaw opening 20. The tolerances for the particular truck design of the present invention, marked "X", are set at 0.030 inch, and with these specific tolerances, the axles will be able to longitudinally move with respect to the sideframes and negotiate a turn having 7.5 radius of curvature. Trucks which must negotiate tighter curves must have larger tolerances provided here. The thrust lugs ultimately limit the amount of longitudinal movement each axle can travel and it should be clear that when the bearing adapter movement is limited, bearing 25 is likewise limited.

Figure 2A:
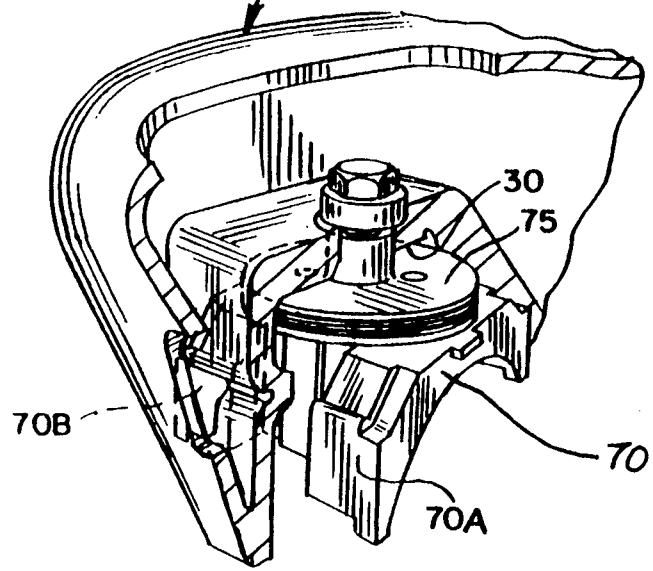
FIG. 2A is a fragmentary perspective view of the pedestal jaw area detailing the relationship between the bearing adapter and the sideframe.

FIG. 2A also illustrates post sections 70A and 70B at each front and back corner of bearing adapter 70 for limiting the transverse movement of adapter 70 with respect to sideframe 12.

Figure 3:
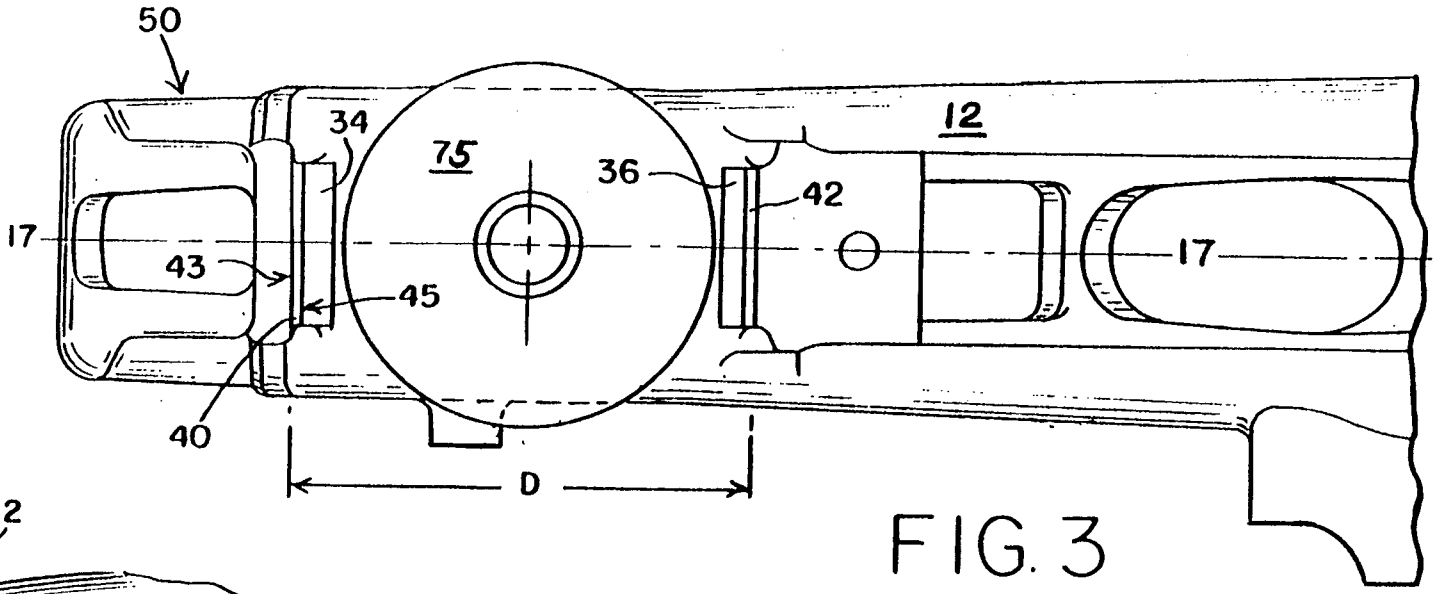
FIG. 3 is an enlarged fragmentary bottom view of a pedestal jaw, illustrating the position of the present invention and in relation to the pedestal thrust lugs.

Referring now to FIGS. 2 and 3, it is illustrated that sideframe 12, incorporating the structure of the present invention in the form of an opposed pair of positioning lugs 40,42 disposed on opposite sides of pedestal jaw walls 28,29. It is important that realize that the exact position of positioning lugs 40,42 is a very important part of this invention and as seen, the lugs are located exactly at the axle longitudinal centerline, designated at 17. Since each of the positioning lugs 40,42 and pedestal jaw areas 50,60 are identical, only one positioning lug and pedestal jaw area will be described in greater detail.

Positioning lug 40 is preferably made from a material which provides resistance to bearing or shear forces between the lug and the roller bearing 25 whenever axle 16 twists or moves longitudinally and causes outside lug surface 45 to frictionally engage outside wheel bearing surface 26. Preferably, each positioning lug is machined from the as-cast material which has been specifically added to this area on the pedestal jaw. The machining is performed in exactly the same manner as for machining the pedestal thrust lugs. In accordance with the present invention, it is preferable that each lug is of an equal rectangular shape, with the sides being longer in extent than the height of the lugs. Alternatively, instead of machining the lugs from the as-cast material, steel shims could also be welded to flattened, pedestal jaw walls instead. The inside lug surface 43 of the shim, shown in FIG. 3, will be in vertical engagement with vertical wall 28 of pedestal jaw 50. The wall 28 is preferably machined in the contact area only, in order to assure substantial face-to-face contact with the shim, as well as ensuring that the shim is attached in a level manner.

Another important aspect of the present invention is that the longitudinal distance between the pedestal jaw walls, designated as distance "D", is actually cast wider than conventional pedestal jaw openings so that the positioning lugs can be accommodated without being tight against the side of bearing surface 26. In previous truck operations, it was discovered that even though the sideframes were being cast to proper tolerances, the dimensional stack-up and the cast wheelbase dimensions were varying from sideframe to sideframe. Wheelbase variations occasionally caused the axle(s) to be tight against the bearing upon assembly of the truck, creating a slight longitudinal displacement of the bearing within the pedestal jaw. The bearing displacement also caused slight shearing of bearing adapter elastomeric pad 75, such that bearing adapter 70 was no longer in a neutral or centered position when the truck was placed into service. This condition necessarily meant that axle 16 was slightly cocked even though the pedestal thrust lugs are first machined so that the bearing adapter could be precisely positioned within the pedestal jaws. Although the actual distance which the axle will become cocked amounts to only a few thousandths of an inch, the truck was found to develop a substantial amount of resultant drag on tangent track. Furthermore, the initial axle displacement within the pedestal jaw longitudinally restricted the axle from moving as desired within jaw opening 20 because the axles would contact a pedestal jaw wall before the allowed travel tolerance was exhausted. Therefore, in order to properly fit the positioning lugs and provide the full amount of travel tolerance, the sideframes must have the jaw opening dimension D widened by casting them slightly larger than normal. Doing so will also prevent possible deep, destructive machining of the pedestal wall base surfaces.

FIG. 3 illustrates that positioning lug 40 extends traversely across the entire extent or width of each of the pedestal jaws and as mentioned, are placed at the axle longitudinal centerline 17. In this particular truck application, positioning lug 40 is machined to a tolerance of 0.035 inches between the lug and the bearing, designated as "Y" in FIG. 2, only after thrust lugs 34,36 are first machined. The distance between positioning lug 40 and roller bearing 25 is preferably 0.005 inch wider than the 0.030 inch tolerance between bearing adapter 70 and thrust lug so that the axles will be guaranteed the clearance necessary for fully negotiating a 7.5° curve, otherwise, the axles could be longitudinally limited from moving by the positioning lugs. In this way, the positioning lugs 40,42 will act as backup stops to the thrust lugs so that if the axles happen to displace further than the 0.030 inch tolerance, the positioning lugs will stop the axles from displacing even further. By ensuring that the designed range of longitudinal motion will be provided, the truck will exhibit improved yaw and lateral stability. Moreover, when the axles begin to encounter linear track again, the positioning lugs will maintain the axles in a perpendicular relationship with respect to sideframe 12, and this in turn will reduce tangent track drag by forcing the truck back into its perpendicular, H-shape.

Alternatively, instead of using machined elastomeric pads, steel shims (not shown) could be welded to the pedestal walls, with the thicknesses being determined by gaging after the pedestal thrust lugs 34,36 have been machined per the practice just mentioned. However, the longitudinal distance between the pedestal walls still has to be increased in order to take account for the additional tolerances of the shims. It is recommended to prepare the pedestal jaw wall surface either by machining or grinding so that the shims will sit flatly against the pedestal jaw surfaces.

The foregoing description has been provided to clearly define and completely describe the present invention. Various modifications may be made without departing from the scope and spirit of the invention which is defined in the following claims.

What is claimed is:

1. An improved railway car truck assembly having a longitudinal axis, said truck including a pair of longitudinally extending and laterally spaced sideframes that are joined by a front and rear axle, each of said frames having a front end with a front pedestal jaw and a rear end with a rear pedestal jaw, each of said pedestal jaws formed by a vertically disposed forward wall, a vertically disposed rearward wall, and a horizontally disposed pedestal roof interconnected each of said walls, thereby defining a pedestal jaw opening, said forward and rearward walls of each pedestal jaw opening of equal vertical and lateral extent, each said pedestal jaw opening accommodating a wheel bearing adapter mounted to said pedestal jaw roof and a roller bearing, said roller bearing operably held within said pedestal jaw opening by said wheel bearing adapter, said forward and rearward walls of each said pedestal jaw including a respective forward and rearward thrust lug for longitudinally and laterally centering a respective said bearing adapter within said pedestal jaw opening and for providing limited longitudinal and lateral freedom within said jaw opening, said front and rear axles each rotationally coupled to respective said roller bearings on each of said sideframes, the improvement comprising:

a forward and a rearward positioning lug respectively mounted on said forward and rearward walls of each said pedestal jaw, said forward and rearward positioning lugs in horizontal alignment with each other and respectively interposed between said forward and rearward pedestal jaw walls and said roller bearing at a longitudinal centerline of said axle when said axle is accommodated within said pedestal jaw opening, each said positioning lug traversing said lateral extent of said pedestal jaw vertical wall such that a limited longitudinal tolerance exits between said positioning lug and said roller bearing to allow longitudinal displacement of said axles relative to each of said sideframes when said truck negotiates a turn, said positioning lugs providing resistance against said roller bearing, thereby assisting said axles in returning to a substantially right angular relationship with respect to each of said sideframes when said truck encounters linear track.

2. The railway truck of claim 1 wherein said pedestal jaw positioning lugs allows said truck to negotiate turns having varying degrees of curvature.

3. The railway truck of claim 2 wherein said positioning lugs at each said pedestal jaw maintain each said axle in a generally centered relationship within said pedestal jaw opening.

4. The railway truck of claim 2 wherein each of said respective pedestal jaw positioning lugs is integrally cast as part of said respective sideframe pedestal jaw and is machined after each of said respective thrust lugs are machined so that said thrust lug machining initially centers each respective said axle within said respective pedestal jaw, said positioning lug machining thereby maintaining a substantially right angular relationship between each of said axles and each of said sideframes when said trunk travels upon linear track.

5. The railway truck of claim 2 wherein each of said positioning lugs is comprised of a metallic shim welded to a respective said pedestal jaw wall, said shims all being substantially equal in size.

6. The railway truck of claim 1 wherein said longitudinal tolerance between said forward thrust lug and said bearing adapter is substantially equivalent to said longitudinal tolerance between said rearward thrust lug and said same bearing adapter.

7. The railway truck of claim 6 wherein said longitudinal tolerance between said forward thrust lug and said bearing adapter is less than said longitudinal tolerance between said positioning lugs and said roller bearing.

8. An improved railway truck sideframe in a railway car, said sideframe having a front end, a rear end, a midsection therebetween and a longitudinal axis, said sideframe defined by a longitudinally extending top member, a longitudinally extending bottom member, and a pair of vertically disposed support columns having longitudinal spacing therebetween such that said top and bottom members are interconnected at said midsection, said top and bottom members also connected to each other at each of said sideframe ends thereby forming a front and rear pedestal jaw for accommodating a respective front and rear wheeled axle, each of said front and rear pedestal jaws defined by a vertically disposed forward wall, a vertically disposed rearward wall and roof interconnecting each of said walls, each said pedestal jaw opening accommodating a wheel bearing adapter mounted to said pedestal jaw roof and a roller bearing, said roller bearing operably held within said pedestal jaw opening by said wheel bearing adapter, said forward and rearward walls of each said pedestal jaw including a respective forward and rearward thrust lug for longitudinally and laterally centering a respective said bearing adapter within said pedestal jaw opening and for providing limited longitudinal and lateral freedom within said jaw opening, said front and rear axles each rotationally coupled to respective said roller bearings on each of said sideframes, the improvement comprising:

a forward and rearward positioning lug respectively mounted on said forward and rearward walls of each of said pedestal jaw, said forward and rearward positioning lugs in horizontal alignment with each other and respectively interposed between said forward and rearward pedestal jaw walls and said roller bearing at a longitudinal centerline of said axle when said axle is accommodated within said pedestal jaw opening, each said positioning lug transversing said lateral extent of said pedestal jaw vertical wall such that a limited longitudinal tolerance exists between said positioning lug and said roller bearing to allow longitudinal displacement of said axles relative to each of said sideframes when said truck negotiates a turn, said positioning lugs providing resistance against said roller bearing, thereby assisting said axles in returning to a substantially right angular relationship with respect to each of said sideframes when said truck encounters linear track.

9. The invention of claim 8 wherein said longitudinal tolerance between said forward thrust lug and said bearing adapter is substantially equivalent to said longitudinal tolerance between said rearward thrust lug and said same bearing adapter.

10. The invention of claim 9 wherein said longitudinal tolerance between said forward thrust lug and said bearing adapter is less than said longitudinal tolerance between said positioning lugs and said roller bearing.

11. The invention of claim 10 wherein said positioning lugs at each said pedestal jaw assist said thrust lugs in maintaining said axles in a generally centered relationship within said pedestal jaw opening.

12. The invention of claim 8 wherein said pedestal jaw positioning lugs allow said railway truck to negotiate turns having varying degrees of curvature.

* * * * *